US005807167A

United States Patent [19]

Walsh

[11] Patent Number: 5,807,167

[45] Date of Patent: Sep. 15, 1998

[54] FOAM PAD RESURFACER

[76] Inventor: George F. Walsh, 1300—12th St. SE., Willmar, Minn. 56201

[21] Appl. No.: 728,539

[22] Filed: Oct. 9, 1996

Related U.S. Application Data

[63] Continuation-in-part of Ser. No. 720,084, Sep. 27, 1996.

[51] Int. Cl.[6] ..... B24B 1/00

[52] U.S. Cl. ..... 451/56; 451/319; 451/324; 451/444; 451/552; 451/555; 15/236.08

[58] Field of Search ..... 451/56, 312, 317, 451/318, 324, 493, 444, 319, 552, 553, 555; 29/76.1, 77, 81.11, 81.17; 15/93.1, 236.08, 237

[56] References Cited

U.S. PATENT DOCUMENTS

| | | | |
|---|---|---|---|
| 571,358 | 11/1896 | Gilmore | 29/76.1 |
| 2,843,870 | 7/1958 | Perry | 15/237 |
| 3,831,577 | 8/1974 | Price | 125/26 |
| 4,356,671 | 11/1982 | Gabrielson et al. | 451/56 |
| 4,425,677 | 1/1984 | Cox | 15/104.92 |
| 5,081,051 | 1/1992 | Mattingly et al. | 451/56 |
| 5,146,909 | 9/1992 | Ruark et al. | 125/11.01 |
| 5,421,126 | 6/1995 | Strege | 451/296 |
| 5,595,527 | 1/1997 | Appel et al. | 451/285 |

*Primary Examiner*—Eileen P. Morgan
*Attorney, Agent, or Firm*—Westman, Champlin & Kelly, P.A.

[57] ABSTRACT

A resurfacer for resurfacing a working surface of a foam pad used for polishing auto finishes, in particular, includes a base having a support surface for supporting a polishing pad while it is being driven by a polisher power unit with which the polishing pad is used for the actual polishing operation. The base surface has an abrading section made of, preferably, partially perforated thin steel so that sharp corners protrude a selected height above the base surface and a guide fence for guiding the polishing pad as it is moved across the abrading pad so that it is held true and square, until the polishing pad is provided with a new flat and square working surface. The support surface is of size so that it will support the entire polishing pad while the abrading pad has a width slightly more than one-half the diameter of the polishing pad so that the polishing pad is stably held and can be made true and flat. The surface of the abrading pad is much like a grater that is used for grating vegetables, as disclosed, but can be any desired abrasive material.

15 Claims, 5 Drawing Sheets

FOAM PAD RESURFACER

CROSS REFERENCE TO RELATED APPLICATION

This application is a continuation-in-part of my copending application Ser. No. 08/720,084 filed Sep. 27, 1996 entitled FOAM PAD RESURFACER.

BACKGROUND OF THE INVENTION

The present invention relates to a resurfacer for restoring a working surface of a polishing pad.

Recent developments for obtaining a blemish free painted surface on a repaired auto, which matches the original paint luster include the use of power driven rotary foam polishing pads that provide a sufficient polishing action, without abrading the surface or causing scratches. However, the foam pads are relatively fragile and wear unevenly, with the edges rounding off need to be resurfaced and restored from time to time if the pad life is to be extended. The foam pad cells also will fill up with paint, polishing agents or dirt. Between the effects of uneven wear and clogging the pads soon become unsatisfactory for use.

Various reconditioning tools have been advanced for rotary foam pads, but none which quickly restore the pad working surface to be flat and squared to the axis of rotation and which restore and square up the edges of the pad. Hand held tools such as wire brushes have been used in the past for removing a layer of foam from a pad, but handheld brushes produce irregular, non planar surfaces unless the operator is highly skilled. Handheld tools also are prone to damaging the pad in that they can catch on the pad as it is being rotated.

SUMMARY OF THE INVENTION

The present invention provides a resurfacer for resurfacing polishing pads by moving a rotating polishing pad along a support and over an abrading surface section and abrading away a layer from the polishing pad working surface. The working surface may become uneven or become clogged or partially clogged with paint, polishing agents or the like. The present resurfacer provide a new, true, flat or planar surface for the polishing pad. The resurfacer comprises a base member that has a large substantially planar support surface to fully support the pad being resurfaced, and which has an abrading pad section that is relatively small in relation to the support surface. The abrading section preferably has a "grater" type surface facing upwardly.

The abrading section forms an abrading pad with an upper surface parallel to and substantially flush with the support surface of the base. A guide fence having a guide surface perpendicular to the support surface is provided adjacent to the grater surface of the abrading pad. The polishing pad is left in place on the polishing drive tool and is supported on the planar support surface. The polishing pad can be oriented relative to both the guide fence and the abrading pad section in a preselected, precise position. The polishing pad is rotated by the drive tool and moved along the guide fence so that its path of travel is in a straight line. When the polishing pad is moved across the abrading pad a thin surface layer of the polishing pad is abraded away.

The abrading pad extends laterally from the guide fence preferably a distance slightly more than the radius of the polishing pad. The linear motion of the polishing pad is similar to that used for polishing, and as it moves across the abrading pad, the polishing pad surface is restored to a flat, and original condition. A desired number of passes across the abrading pad can be made until rounded edges of the polishing pad are squared up, the polishing surface is flat and all of the material that accumulates on the polishing surface of a polishing pad is removed.

Various types of abrading surfaces can be used for the abrading, but preferably a surface similar to a vegetable grater is provided. The abrading pad thus has a plurality of openings formed by punching through a thin metal sheet without removing material to leave projections that are capable of abrading the surface of the foam pad. The height of the abrading projections is kept very low, but is sufficient so that it will abrade away the foam pad as the polishing pad is moved across the abrading pad surface.

The present invention thus provides a structure for reconditioning foam pads to reduce the waste that occurs at the present time when pads are thrown away after they have become clogged. The present resurfacer provides the operator with a true, flat polishing surface of unused pad material exposed for polishing operations that restore a finish to its original like new condition.

DETAILED DESCRIPTION OF THE PREFERRED EMBODIMENTS

Figure 1:
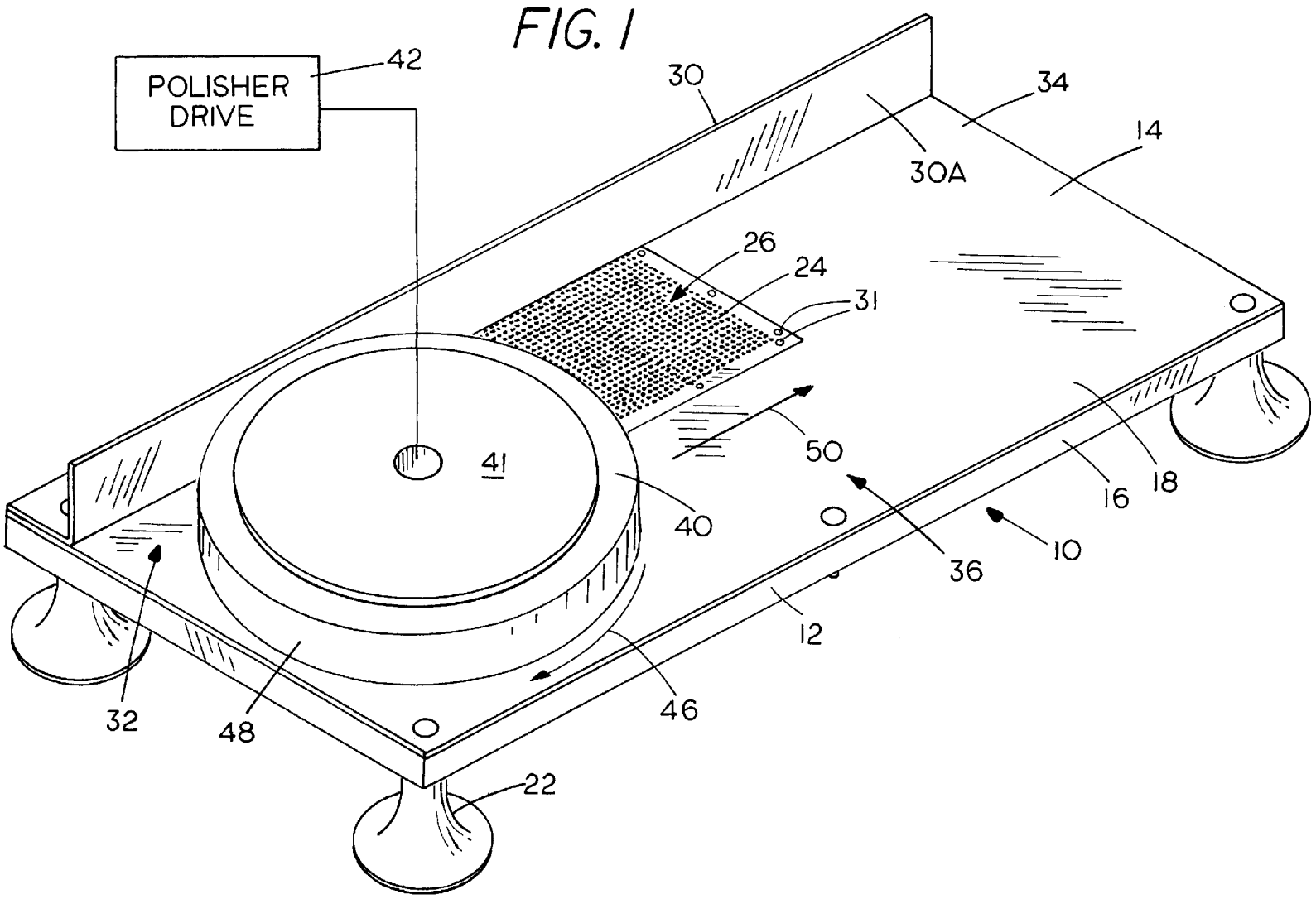
FIG. 1 is a perspective view of a pad resurfacing tool made according to the present invention illustrating a pad to be resurfaced adjacent a resurfacing pad portion.
Figure 2:
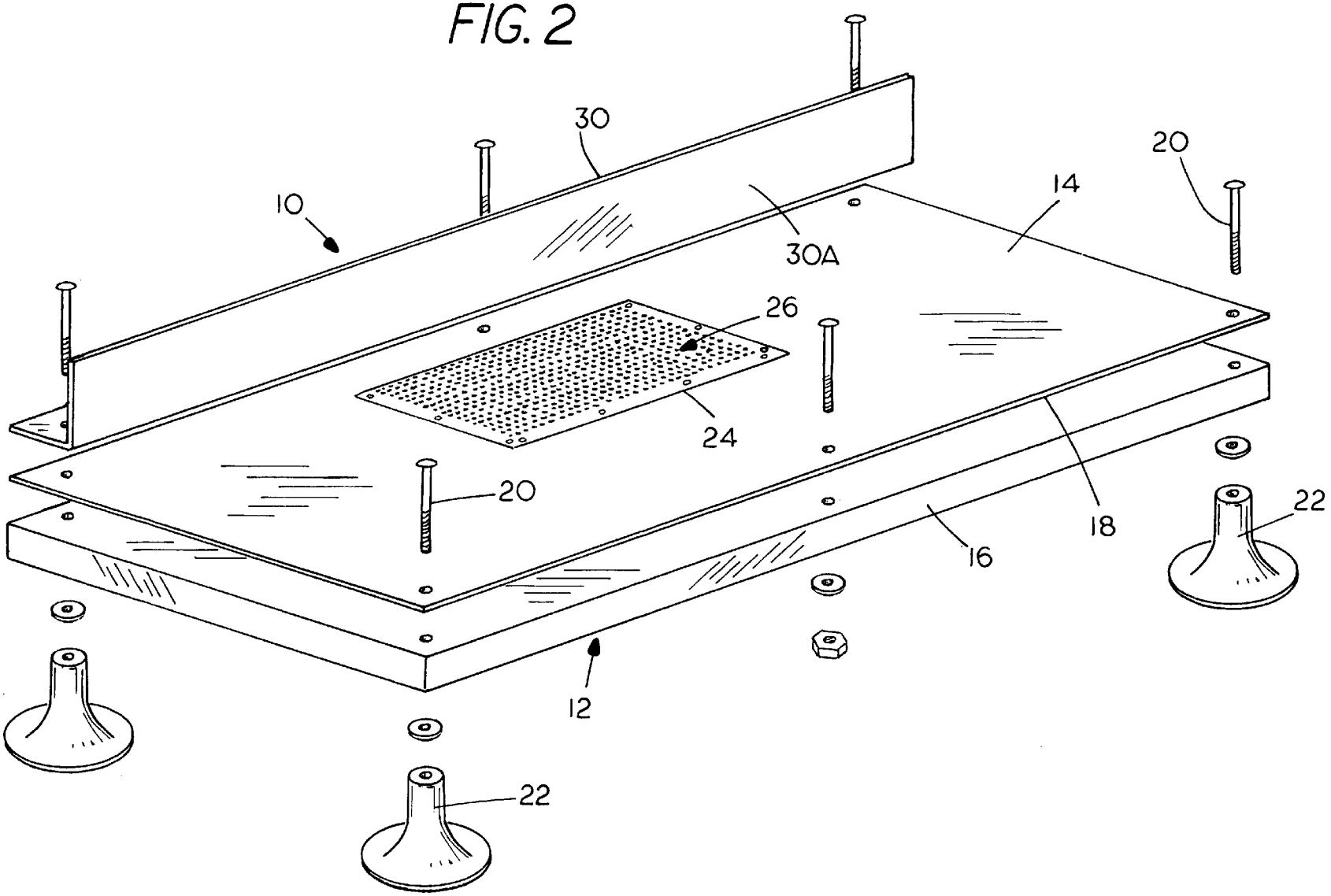
FIG. 2 is an exploded perspective view of the pad resurfacer of the present invention.
Figure 3:
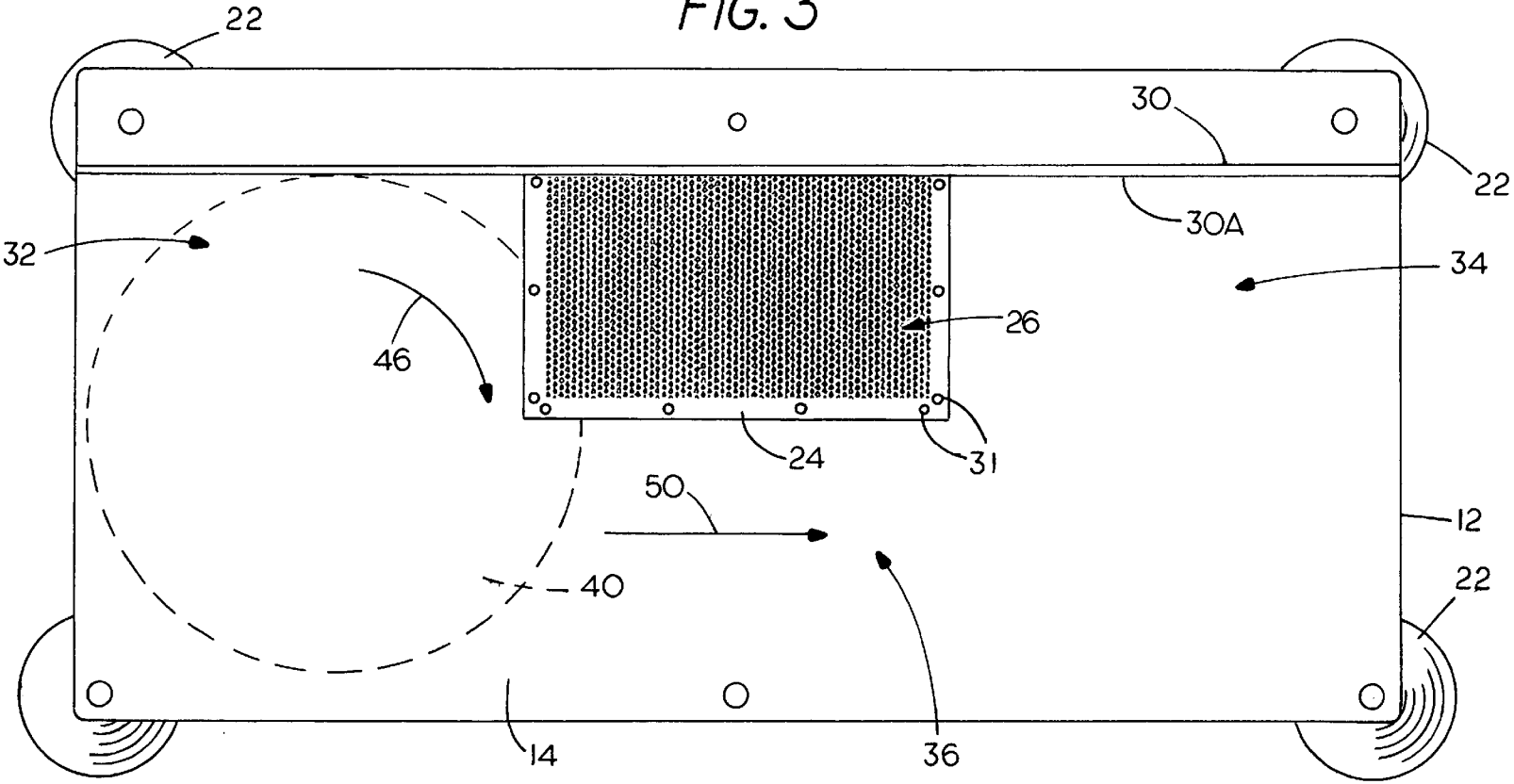
FIG. 3 is a top plan view of the device of FIG. 1.
Figure 4:
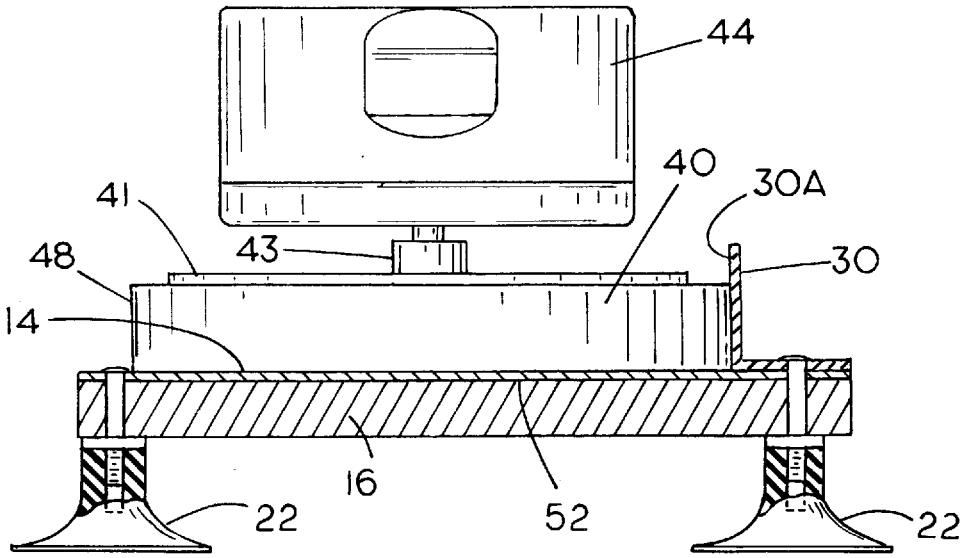
FIG. 4 is an end elevational view of the device of FIG. 1 as taken from the right-hand end thereof shown in FIG. 3.

Referring to FIG. 1, the pad resurfacer assembly indicated generally at 10 includes a base 12 that has a substantially planar upper surface 14. The base 12 includes a stable, rigid bottom plate 16 which may be covered with a smooth surface material, such as a thin stainless steel sheet 18, shown perhaps best in FIG. 2. The bottom plate 16 and the sheet 18 are held together with suitable fasteners 20 that, in the corners, can be used to support suction cups 22. The suction cups 22 are used as a support for the base 12 to hold it stably on a workbench surface or the like. The suction cups 22 can be replaced by other supports, and if desired, the base 12 may be positioned flat against a support surface and held from slipping during the resurfacing operation.

An abrasive surface reconditioning pad 24 (called an abrading pad) is attached to the base 12, near the midline in fore and aft (longitudinal) direction and adjacent one side of the base. The abrading pad 24 has a surface 26 that is formed with a number of individual partial punched projections, much like a vegetable grater, in the preferred form. A schematic representation is shown in FIG. 6, to show in a greatly enlarged view, the type of abrasion protrusions that are provided.

Figure 6:
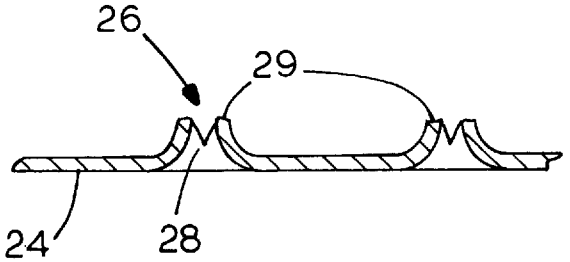
FIG. 6 is an enlarged fragmentary sectional view to illustrate a preferred abrading surface.

The abrading or reconditioning pad 24, as shown in FIG. 6, partially punched out holes 28 that form projections 29 having ends that provide the surface 26. The projections 29 are at a desired spacing, for example having the projections approximately one-eighth of an inch on center along diagonal rows will work well. The rows are positioned at substantially 45° relative to the direction of travel of a foam polishing pad as it is being resurfaced. The projections are offset in adjacent rows so the effective spacing is reduced with respect to the direction of travel. The projections 29 can protrude from the main surface of the abrading pad in the range of one-sixteenth of an inch to give an aggressive upper surface 26. The abrading pad shown in FIG. 6 may be made out of a thin stainless steel before the projections are made or can be made of spring steel for longer life. The projections 29 of the partially punched out openings protrude from one surface much like a vegetable grater. The punched through openings 28 have an opening diameter of about one-sixteenth inch. The material adjacent the edges of the partial punch out tear open to form the projections 29. The projections have relatively sharp and irregular ends so that they will provide an aggressive surface.

The abrading pad 24 can be held in position on the base 12 by slipping one edge under a guide fence 30 and also with suitable rivets or other fasteners shown generally at 31. The abrading pad 24 is quite thin, so that it does not protrude a great distance above the surface 14 of sheet 18.

Guide fence 30 forms an upright guide surface 30A and is positioned adjacent to or partially overlaps one edge of abrading pad 24. The surface 30A is perpendicular to the surface 14.

As can be seen, the abrading pad 24 is positioned so that there is a lead-in surface portion 32, and a trailing surface portion 34 at opposite ends of the abrading pad, as well as a support surface portion 36 alongside the abrading pad. A polishing pad 40 that as shown is made of a foam and commercially available is used for polishing painted surfaces on automobiles and the like. The working or polishing surface will round off at its edges and tend to become clogged or coated with old wax, polished away paint, polishing compound and the like. The polishing pad then no longer functions well for its intended purpose of polishing, and has to be discarded or reconditioned.

Figure 5:
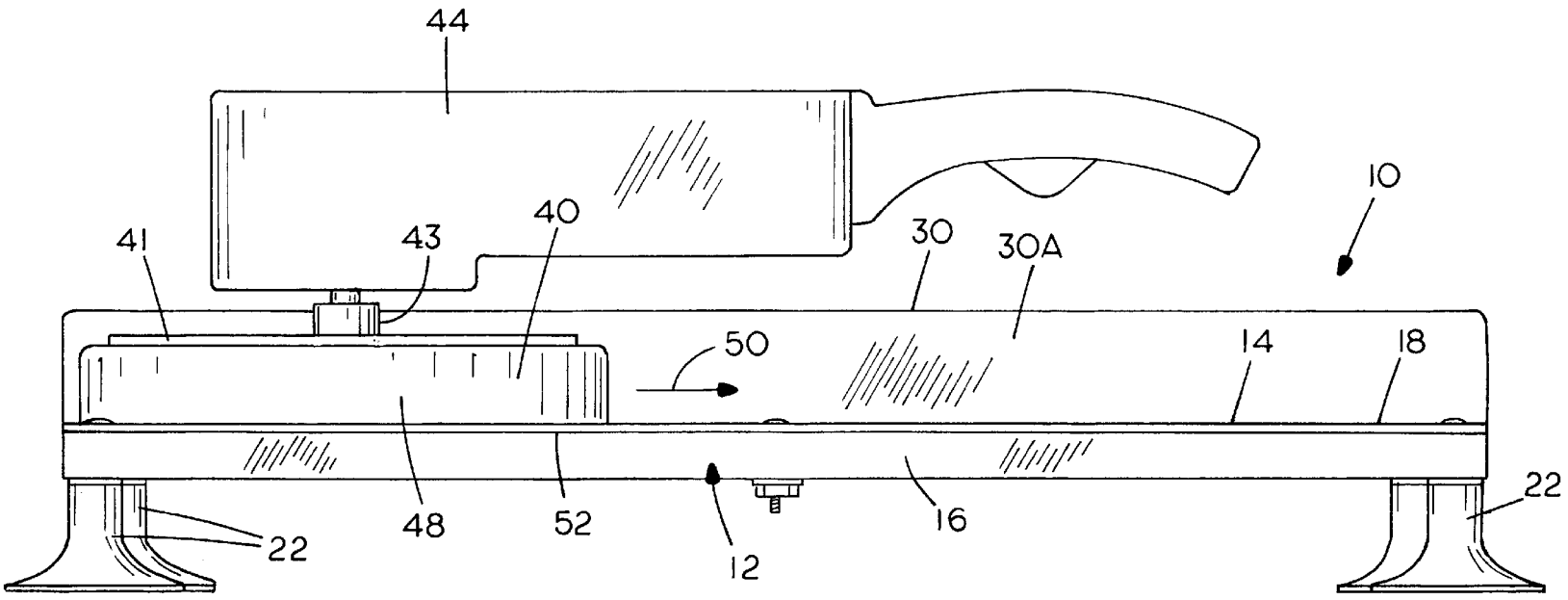
FIG. 5 is a side elevational view thereof.

In order to recondition the polishing pad 40 using the reconditioner 10, the polishing pad 40 is driven with a polisher drive 42, which is part of the polishing head power unit 44 that is shown in FIG. 5 schematically. The polishing head power unit 44 or drive 42 will rotate the polishing pad 40 in the direction as indicated by the arrow 46 in FIG. 1, and also in other figures.

The edge surface 48 of the polishing pad 40 will be positioned against the guide surface 30A of the guide fence 30. The working surface 52 (FIG. 5) of the polishing pad is placed against the surface 14. The polisher drive 42 is powered so that the polishing pad 40 is rotating at its normal operating speed which may be in the range of 1,200 to 1,500 RPM. Then the polishing pad is pulled in the direction of the arrow 50 across the abrading pad 24, with only the weight of the power unit on the polishing pad. The operator thus would stand at the end 34 and pull the polishing pad across the abrading pad for resurfacing.

The abrading projections 29 on the abrading surface 26 will engage the working surface 52 of the polishing pad which is indicated at 52 in FIG. 5, as the rotating polishing pad is pulled in the direction of arrow 50, to abrade away a layer from the working surface 52. Foreign materials as well as part of the pad are removed to provide a new unused layer of the polishing pad 40 exposed at the working surface.

The resurfacing operation can continue for as many passes as desired in order to obtain the needed reconditioning. The abrading can continue on the surface 52 until any rounded the corners between the polishing pad edge surface 48 and the surface 52 are squared. These corners tend to be rounded off or chewed up during polishing operations. The debris removed by the abrading pad can be brushed off or blown off with an air nozzle.

Polishing pads 40 are either integrally attached or held in suitable manner on a backing plate 41 that has a threaded sleeve 43 that threads onto a spindle of a polishing head 44, for driving it. The polishing pad may be attached to the backing plate 41 with hook and loop fasteners sold under the trademark VELCRO. Integral pads and backing plates are preferred for the polishing pads.

It can be seen that the lateral width of the abrading or reconditioning pad 24 as shown, essentially one-half of the diameter polishing pad 40 and may be, preferably slightly wider than the polishing pad radius. For example, for an 8 inch pad (4 inch radius) the exposed abrading portion of the abrading pad may be 4¼ inches. The other half or so of the polishing pad is stabilized by supporting it on the adjacent portion of surface 14 which is substantially co-planar with the surface of the abrading or reconditioning pad 24. The majority of the polishing pad remains support on surface 14 while the reconditioning is taking place.

In this manner, a very stable support is provided and the surface of the polishing pad that is exposed after the abrading action is truly planar.

The reconditioning apparatus thus provides for rapid and reliable reconditioning of foam polishing pads, thereby extending their useful life and reducing waste.

The abrading pad can be made of abrading materials such as aluminum oxide coated metal or paper, scouring pad materials or other surfaces that abrade away foam and have an acceptable life.

Other types of polishing pads can be reconditioned, as long as the working surface can be abraded away to provide a new surface for polishing.

It should be noted that the sheet 18 can be partially punched out in a section to form an integral abrading section, instead of using a separate abrading pad.

Although the present invention has been described with reference to preferred embodiments, workers skilled in the art will recognize that changes may be made in form and detail without departing from the spirit and scope of the invention.

What is claimed is:

1. A resurfacing apparatus for resurfacing a planar working surface of a polishing pad, the planar working surface having a transverse dimension, comprising:

a base having a substantially planar upper surface with a lateral width greater than the transverse dimension of the polishing pad to be resurfaced, to provide a support for the entire polishing pad working surface; and an abrading section on a portion of the upper surface of the base for abrading away a portion of a polishing pad planar working surface in contact with the abrading section, to permit a polishing pad to be supported on the planar upper surface of the base and moved across the abrading section to resurfacer a portion of the planar working surface of the polishing pad.

2. The apparatus of claim 1 and a guide fence having a substantially planar surface positioned adjacent to and extending substantially normal to the upper surface of the base.

3. The apparatus of claim 2, wherein the polishing pad to be resurfaced has an axis of rotation perpendicular to the planar working surface, the pad having a radius of rotation, the abrading section extending laterally of the guide fence a distance in the range of the radius of the polishing pad to be resurfaced.

4. The apparatus of claim 2 and means for holding the base in position on a support.

5. The apparatus of claim 1, wherein said abrading section comprises a separate metal sheet having partial punch outs forming a rough metal surface which engages the polishing pad.

6. The apparatus of claim 3, wherein said upper surface of said base extends laterally of said abrading section, and also extends for a distance from said abrading section on selected sides in the range of one half of lateral dimension of the working surface of the polishing pad whereby the polishing pad to be resurfaced is supported on the upper surface of the base adjacent the abrading section as such polishing pad is moved across the abrading section.

7. The apparatus of claim 1 in combination with a polishing tool having a polishing pad to be abraded thereon, said polishing tool powering the polishing pad for rotation as the polishing pad is moved along the upper surface of the base and across the abrading section.

8. A method of resurfacing a rotatable polishing pad having a planar working surface perpendicular to an axis of rotation of the pad comprising the steps of providing a base having a substantially planar upper surface with an abrading section spaced inwardly from selected edges of said base;

supporting a polishing pad on a rotating drive and rotating the polishing pad while the planar working surface is in engagement with the upper surface of the base; and moving the polishing pad across the abrading section while it is being rotated, while maintaining the planar working surface of the pad partially supported on portions of the planar upper surface other than the abrading section.

9. The method of claim 8, including the step of guiding the pad with a guide surface that is substantially planar and extends in a selected direction of movement of the polishing pad.

10. The method of claim 9, wherein the pad is a foam polishing pad and has a thickness defining a cylindrical peripheral edge surface, and placing the cylindrical perpendicular edge surface against said guide surface during the moving step.

11. The method of claim 10, wherein the moving step comprises manually moving the polishing pad across the abrading section and manually holding the peripheral edge surface against the guide surface as the polishing pad is moved across the abrading section.

12. The method of claim 8, wherein the rotating drive comprises a hand held power unit having an output shaft driving the rotating polishing pad for the rotating step.

13. A rotating polishing pad resurfacer for resurfacing a manually held power driven rotating polishing pad having a substantially planar surface perpendicular to an axis of rotation, and a thickness parallel to the axis of rotation to define an edge surface, the resurfacer comprising a base having a planar upper surface with a section of the upper surface formed to have an abrasive section facing upwardly, the rest of the upper surface being substantially smooth, and said upper surface being of larger size than the polishing pad;

a guide fence extending substantially perpendicular to the upper surface and extending along the abrading section and being of size to guide the edge surface of the pad to be resurfaced while the pad is being rotated;

the planar surface being substantially continuous and the abrading section being of size such that it extends perpendicular to the guide fence a distance in the range substantially equal to the radius of rotation of the pad to be resurfaced, whereby said smooth surface supports a pad to be resurfaced as such pad is moved across the abrading surface while the pad is rotated.

14. The resurfacer of claim 13, wherein the polishing pad is a foam pad and the abrading section has projections extending upwardly from a plane of the smooth portions of the upper surface in the range of 1/16 of an inch.

15. The resurfacer of claim 13, wherein said abrading section has a plurality of projections that are spaced apart approximately 1/8 of an inch on center along rows that extend diagonally to the plane of the guide.

* * * * *